US008632282B2

(12) United States Patent
Taylor

(10) Patent No.: US 8,632,282 B2
(45) Date of Patent: Jan. 21, 2014

(54) MECHANICALLY STABILIZED EARTH SYSTEM AND METHOD

(75) Inventor: Thomas P. Taylor, Colleyville, TX (US)

(73) Assignee: T & B Structural Systems LLC

( * ) Notice: Subject to any disclaimer, the term of this patent is extended or adjusted under 35 U.S.C. 154(b) by 471 days.

(21) Appl. No.: 12/818,011

(22) Filed: Jun. 17, 2010

(65) Prior Publication Data

US 2011/0311318 A1 Dec. 22, 2011

(51) Int. Cl.

| | |
|---|---|
| ***E02D 3/02*** | (2006.01) |
| ***E02D 5/00*** | (2006.01) |
| ***E02D 17/00*** | (2006.01) |
| ***E02D 29/00*** | (2006.01) |

(52) U.S. Cl.
USPC ..... 405/284

(58) Field of Classification Search
USPC ..... 405/262, 284, 258.1, 302.4
See application file for complete search history.

(56) References Cited

U.S. PATENT DOCUMENTS

| | | | | |
|---|---|---|---|---|
| 991,041 | A | 5/1911 | Toennes | |
| RE13,299 | E | 10/1911 | Denison | |
| 1,144,143 | A | 6/1915 | McGillivray | |
| 1,813,912 | A | 7/1931 | Clark | |
| 1,959,816 | A | 5/1934 | Crum | |
| 1,992,785 | A | 2/1935 | Steuer | |
| 2,137,153 | A | 11/1938 | Brozek | |
| 2,208,589 | A | 7/1940 | Leemhuis | |
| 2,275,933 | A | 3/1942 | Werner | |
| 2,316,712 | A | 4/1943 | Prince | |
| 2,327,640 | A | 8/1943 | Hendry | |
| 2,552,712 | A | 5/1951 | Ellis | |
| 2,703,963 | A | 3/1955 | Gutierrez | |
| 2,881,614 | A | 4/1959 | Preininger | |
| 3,597,928 | A | 8/1971 | Pilaar | |
| 3,680,748 | A * | 8/1972 | Brunhuber | 223/98 |
| 3,998,022 | A | 12/1976 | Muse | |
| 4,075,924 | A | 2/1978 | McSherry | |
| 4,116,010 | A | 9/1978 | Vidal | |

(Continued)

FOREIGN PATENT DOCUMENTS

| | | |
|---|---|---|
| EP | 427221 A | 5/1991 |
| EP | 0679768 | 2/1995 |
| FR | 530097 | 9/1921 |
| FR | 1006087 | 1/1952 |
| JP | 3114014 | 6/1991 |
| JP | 08209703 | 8/1996 |
| JP | 08326074 | 12/1996 |

(Continued)

OTHER PUBLICATIONS

International Application No. PCT/US08/69011—International Search Report and Written Opinion dated Oct. 10, 2008.

(Continued)

*Primary Examiner* — Frederick L Lagman
*Assistant Examiner* — Patrick Lambe
(74) *Attorney, Agent, or Firm* — Edmonds & Nolte, PC

(57) ABSTRACT

A system and method of constructing a mechanically stabilized earth (MSE) structure. A wire facing is composed of horizontal and vertical elements, where a soil reinforcing element is coupled to initial and terminal wires of the horizontal element. The soil reinforcing element may have a hook or similar coupling device on its end in order to be coupled to the initial wire. A strut may be coupled to the top-most cross wire of the vertical element and the terminal wire of the horizontal element to maintain the vertical element at a predetermined angle with respect to the horizontal element as backfill is added to the wire facing.

15 Claims, 10 Drawing Sheets

(56) References Cited

U.S. PATENT DOCUMENTS

| | | | | | |
|---|---|---|---|---|---|
| 4,117,686 | A | | 10/1978 | Hilfiker | |
| 4,123,881 | A | | 11/1978 | Muse | |
| 4,134,241 | A | | 1/1979 | Walton | |
| 4,193,718 | A | * | 3/1980 | Wahrendorf et al. | 405/286 |
| 4,286,895 | A | | 9/1981 | Poli | |
| 4,324,508 | A | | 4/1982 | Hilfiker | |
| 4,329,089 | A | | 5/1982 | Hilfiker | |
| 4,341,491 | A | | 7/1982 | Neumann | |
| 4,343,572 | A | | 8/1982 | Hilfiker | |
| 4,391,557 | A | | 7/1983 | Hilfiker | |
| 4,411,255 | A | | 10/1983 | Lee | |
| 4,470,728 | A | | 9/1984 | Broadbent | |
| 4,505,621 | A | * | 3/1985 | Hilfiker et al. | 405/284 |
| 4,514,113 | A | | 4/1985 | Neumann | |
| 4,616,959 | A | | 10/1986 | Hilfiker | |
| 4,643,618 | A | | 2/1987 | Hilfiker | |
| 4,651,975 | A | | 3/1987 | Howell | |
| 4,653,962 | A | | 3/1987 | McKittrick | |
| 4,661,023 | A | | 4/1987 | Hilfiker | |
| 4,664,552 | A | | 5/1987 | Schaaf | |
| 4,710,062 | A | | 12/1987 | Vidal | |
| 4,725,170 | A | * | 2/1988 | Davis | 405/286 |
| 4,834,584 | A | | 5/1989 | Hilfiker | |
| 4,856,939 | A | * | 8/1989 | Hilfiker | 405/284 |
| 4,914,876 | A | | 4/1990 | Forsberg | |
| 4,920,712 | A | | 5/1990 | Dean, Jr. | |
| 4,929,125 | A | | 5/1990 | Hilfiker | |
| 4,952,098 | A | | 8/1990 | Grayson | |
| 4,961,673 | A | | 10/1990 | Pagano | |
| 4,968,186 | A | | 11/1990 | Ogorchock | |
| 4,993,879 | A | * | 2/1991 | Hilfiker | 405/262 |
| 5,044,833 | A | | 9/1991 | Wilfiker | |
| 5,066,169 | A | | 11/1991 | Gavin | |
| 5,076,735 | A | | 12/1991 | Hilfiker | |
| 5,139,369 | A | | 8/1992 | Jaecklin | |
| 5,156,496 | A | | 10/1992 | Vidal | |
| 5,190,413 | A | | 3/1993 | Carey | |
| 5,207,038 | A | | 5/1993 | Negri | |
| RE34,314 | E | | 7/1993 | Forsberg | |
| 5,257,880 | A | | 11/1993 | Janopaul | |
| 5,259,704 | A | * | 11/1993 | Orgorchock | 405/262 |
| 5,417,523 | A | | 5/1995 | Scales | |
| 5,451,120 | A | | 9/1995 | Martinez-Gonzalez | |
| 5,456,554 | A | | 10/1995 | Barrett | |
| 5,474,405 | A | | 12/1995 | Anderson | |
| D366,191 | S | | 1/1996 | Gay | |
| 5,484,235 | A | | 1/1996 | Hilfiker | |
| 5,487,623 | A | | 1/1996 | Anderson | |
| 5,494,379 | A | | 2/1996 | Anderson | |
| 5,507,599 | A | | 4/1996 | Anderson | |
| 5,522,682 | A | | 6/1996 | Egan | |
| 5,525,014 | A | | 6/1996 | Brown | |
| 5,531,547 | A | * | 7/1996 | Shimada | 405/262 |
| 5,533,839 | A | | 7/1996 | Shimada | |
| 5,582,492 | A | | 12/1996 | Doyle | |
| 5,622,455 | A | | 4/1997 | Anderson | |
| 5,702,208 | A | | 12/1997 | Hilfiker | |
| 5,722,799 | A | * | 3/1998 | Hilfiker | 405/262 |
| 5,730,559 | A | | 3/1998 | Anderson | |
| 5,733,072 | A | | 3/1998 | Hilfiker | |
| D393,989 | S | | 5/1998 | Groves | |
| 5,749,680 | A | | 5/1998 | Hilfiker | |
| 5,797,706 | A | | 8/1998 | Segrestin | |
| 5,807,030 | A | | 9/1998 | Anderson | |
| 5,820,305 | A | | 10/1998 | Taylor | |
| 5,947,643 | A | * | 9/1999 | Anderson et al. | 405/262 |
| 5,951,209 | A | * | 9/1999 | Anderson et al. | 405/262 |
| 5,962,834 | A | * | 10/1999 | Markman | 235/385 |
| 5,965,467 | A | * | 10/1999 | Stevenson et al. | 442/218 |
| 5,971,699 | A | | 10/1999 | Winski | |
| 5,975,809 | A | | 11/1999 | Taylor | |
| 5,975,810 | A | | 11/1999 | Taylor | |
| 6,024,516 | A | | 2/2000 | Taylor | |
| 6,050,748 | A | | 4/2000 | Anderson | |
| 6,079,908 | A | * | 6/2000 | Anderson | 405/262 |
| 6,086,288 | A | | 7/2000 | Ruel | |
| D433,291 | S | | 11/2000 | Shamoon | |
| 6,186,703 | B1 | * | 2/2001 | Shaw | 405/262 |
| 6,336,773 | B1 | | 1/2002 | Anderson | |
| 6,345,934 | B1 | * | 2/2002 | Jailloux et al. | 405/262 |
| 6,357,970 | B1 | | 3/2002 | Hilfiker | |
| 6,517,293 | B2 | * | 2/2003 | Taylor et al. | 405/302.4 |
| 6,595,726 | B1 | * | 7/2003 | Egan et al. | 405/284 |
| 6,793,436 | B1 | * | 9/2004 | Ruel et al. | 403/316 |
| 6,802,675 | B2 | | 10/2004 | Timmons | |
| 6,854,236 | B2 | * | 2/2005 | Bott | 52/609 |
| 6,857,823 | B1 | * | 2/2005 | Hilfiker et al. | 405/262 |
| 6,939,087 | B2 | | 9/2005 | Ruel | |
| 7,033,118 | B2 | | 4/2006 | Hilfiker | |
| 7,073,983 | B2 | * | 7/2006 | Hilfiker et al. | 405/262 |
| 7,270,502 | B2 | | 9/2007 | Brown | |
| 7,281,882 | B2 | * | 10/2007 | Hilfiker et al. | 405/262 |
| 7,399,144 | B2 | * | 7/2008 | Kallen | 405/284 |
| D599,630 | S | | 9/2009 | Taylor | |
| 7,708,503 | B2 | * | 5/2010 | Kohel et al. | 405/302.7 |
| 7,722,296 | B1 | * | 5/2010 | Taylor | 405/262 |
| 7,891,912 | B2 | | 2/2011 | Taylor | |
| 7,972,086 | B2 | | 7/2011 | Taylor | |
| 7,980,790 | B2 | | 7/2011 | Taylor | |
| 8,079,782 | B1 | * | 12/2011 | Hilfiker et al. | 405/262 |
| 2002/0044840 | A1 | | 4/2002 | Taylor | |
| 2002/0067959 | A1 | | 6/2002 | Thornton | |
| 2003/0213203 | A1 | * | 11/2003 | Bott et al. | 52/603 |
| 2003/0223825 | A1 | | 12/2003 | Timmons | |
| 2004/0018061 | A1 | | 1/2004 | Jannsson | |
| 2004/0161306 | A1 | * | 8/2004 | Ruel | 405/284 |
| 2004/0179902 | A1 | * | 9/2004 | Ruel | 405/284 |
| 2005/0111921 | A1 | | 5/2005 | Taylor | |
| 2005/0163574 | A1 | * | 7/2005 | Hilfiker et al. | 405/262 |
| 2005/0260042 | A1 | * | 11/2005 | Kang | 405/302.7 |
| 2005/0271478 | A1 | * | 12/2005 | Ferraiolo | 405/284 |
| 2005/0286980 | A1 | * | 12/2005 | Hilfiker | 405/262 |
| 2005/0286981 | A1 | * | 12/2005 | Robertson et al. | 405/284 |
| 2006/0204342 | A1 | * | 9/2006 | Hilfiker et al. | 405/262 |
| 2006/0204343 | A1 | * | 9/2006 | Kallen | 405/284 |
| 2006/0239783 | A1 | * | 10/2006 | Kallen | 405/284 |
| 2007/0014638 | A1 | | 1/2007 | Brown | |
| 2008/0308780 | A1 | * | 12/2008 | Sloan et al. | 256/31 |
| 2008/0315169 | A1 | * | 12/2008 | McNeill | 256/1 |
| 2009/0016825 | A1 | * | 1/2009 | Taylor | 405/284 |
| 2009/0067933 | A1 | | 3/2009 | Taylor | |
| 2009/0123238 | A1 | * | 5/2009 | Morizot et al. | 405/302.4 |
| 2009/0285639 | A1 | | 11/2009 | Taylor | |
| 2009/0304456 | A1 | * | 12/2009 | Taylor et al. | 405/262 |
| 2010/0247248 | A1 | | 9/2010 | Taylor | |
| 2010/0254770 | A1 | * | 10/2010 | Morizot et al. | 405/302.4 |
| 2011/0170957 | A1 | | 7/2011 | Taylor | |
| 2011/0170958 | A1 | * | 7/2011 | Taylor | 405/262 |
| 2011/0170960 | A1 | | 7/2011 | Taylor | |
| 2011/0229274 | A1 | | 9/2011 | Taylor | |
| 2011/0311317 | A1 | * | 12/2011 | Taylor | 405/273 |
| 2011/0311318 | A1 | | 12/2011 | Taylor | |

FOREIGN PATENT DOCUMENTS

| | | |
|---|---|---|
| KR | 1020080058697 | 6/2008 |
| KR | 1020100027693 | 3/2010 |
| WO | W09413890 | 6/1994 |
| WO | W02009009369 | 1/2009 |
| WO | W02009140576 | 11/2009 |
| WO | W02010082940 | 7/2010 |
| WO | W02011084983 | 7/2011 |
| WO | W02011084986 | 7/2011 |
| WO | W02011084989 | 7/2011 |
| WO | W02011127349 | 10/2011 |
| WO | W02011059807 | 12/2011 |
| WO | W02011159808 | 12/2011 |

OTHER PUBLICATIONS

International Application No. PCT/US09/031494—International Search Report and Written Opinion dated Mar. 13, 2009.

(56) References Cited

OTHER PUBLICATIONS

International Application No. PCT/US09/44099—International Search Report and Written Opinion dated Aug. 12, 2009.
International Application No. PCT/US08/069011—International Preliminary Report on Patentability dated Jan. 21, 2010.
International Application No. PCT/US10/036991—International Search Report and Written Opinion dated Aug. 2, 2010.
International Application No. PCT/US09/44099—International Preliminary Report on Patentability dated Nov. 25, 2010.
International Application No. PCT/US2010/036991—International Preliminary Examination Reported mailed Jul. 14, 2011.
International Application No. PCT/US09/0031494—International Preliminary Report on Patentability dated Jul. 19, 2011.
International Application No. PCT/US2010/036991—Corrected International Preliminary Examination Report mailed Aug. 15, 2011.
International Application No. PCT/US2011/031688—International Search Report and Written Opinion dated Nov. 30, 2011.
International Application No. PCT/US2011/040540—International Search Report and Written Opinion dated Feb. 17, 2012.
International Application No. PCT/US2011/040543—International Search Report and Written Opinion dated Feb. 21, 2012.
International Application No. PCT/US2011/040541—International Search Report and Written Opinion dated Feb. 27, 2012.

* cited by examiner

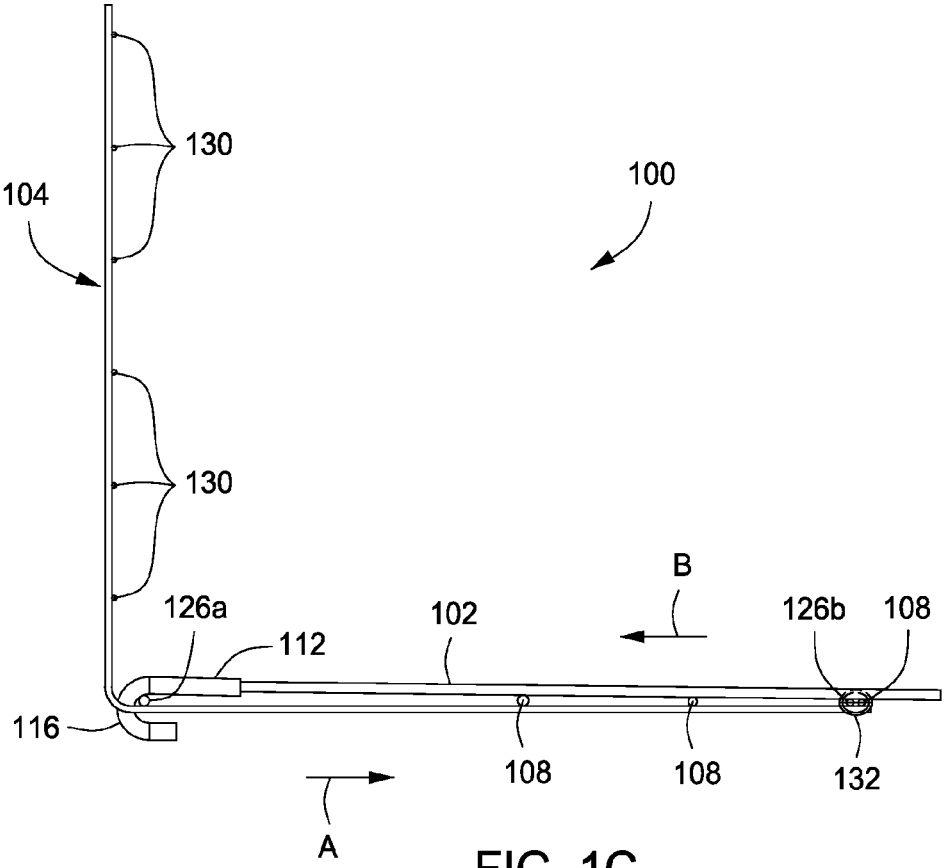
FIG. 1C
FIG. 2
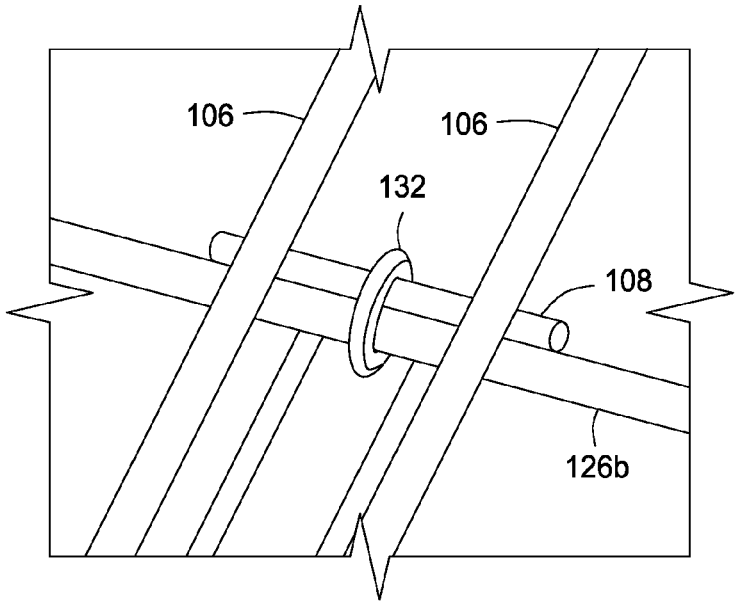

MECHANICALLY STABILIZED EARTH SYSTEM AND METHOD

BACKGROUND OF THE DISCLOSURE

Retaining wall structures that use horizontally positioned soil inclusions to reinforce an earth mass in combination with a facing element are referred to as mechanically stabilized earth (MSE) structures. MSE structures can be used for various applications including retaining walls, bridge abutments, dams, seawalls, and dikes.

The basic MSE implementation is a repetitive process where layers of backfill and horizontally-placed soil reinforcing elements are positioned one atop the other until a desired height of the earthen structure is achieved. Typically, grid-like steel mats or welded wire mesh are used as soil reinforcing elements. In most applications, the soil reinforcing elements consist of parallel, transversely-extending wires welded to parallel, longitudinally-extending wires, thus forming a grid-like mat or structure. Backfill material and the soil reinforcing mats are combined and compacted in series to form a solid earthen structure, taking the form of a standing earthen wall.

In some instances, the soil reinforcing elements can be attached or otherwise coupled to a substantially vertical wall either forming part of the MSE structure or offset a short distance therefrom. The vertical wall is typically made either of concrete or a steel wire facing. The soil reinforcing elements extending from the compacted backfill may be attached directly to the vertical wall in a variety of configurations. The vertical wall not only serves to provide tensile resistance to the soil reinforcing elements but also prevents erosion of the MSE.

Although there are several methods of attaching soil reinforcing elements to facing structures, it nonetheless remains desirable to find improved attachment methods and systems that provide greater resistance to shear forces inherent in such structures.

SUMMARY OF THE DISCLOSURE

Embodiments of the disclosure may provide a system for constructing a mechanically stabilized earth structure. The system may include a soil reinforcing element having a plurality of transverse wires coupled to pair of longitudinal wires, wherein the pair of longitudinal wires have lead ends that converge and are coupled to a connection stud having first and second ends, the first end being coupled to the lead ends and the second end comprising a connector. The system may also include a wire facing having a bend formed therein to form a horizontal element and a vertical facing, the horizontal element having initial and terminal wires coupled to a plurality of horizontal wires, and the vertical facing having a plurality of vertical wires coupled to a plurality of facing cross wires, wherein the connector is coupled to the initial wire, and one of the plurality of transverse wires of the soil reinforcing element is coupled to the terminal wire.

Another exemplary embodiment of the disclosure may provide a method of constructing a mechanically stabilized earth structure. The method may include providing a first lift comprising a first wire facing being bent to form a first horizontal element and a first vertical facing, the first horizontal element having initial and terminal wires coupled to a plurality of horizontal wires, and the first vertical facing having a plurality of vertical wires coupled to a plurality of facing cross wires, and coupling a soil reinforcing element to the initial wire and the terminal wire of the first horizontal element. The method may further include placing a screen on the first wire facing whereby the screen covers at least a portion of the first vertical facing and first horizontal element, and placing backfill on the first lift to a height of the first vertical facing.

Another exemplary embodiment of the disclosure may provide a system for constructing a mechanically stabilized earth structure. The system may include a wire facing bent to form a horizontal element and a vertical facing, the vertical facing having a plurality of vertical wires coupled to a plurality of facing cross wires, and the horizontal element having initial and terminal wires coupled to a plurality of horizontal wires that include a plurality of connector leads, each connector lead comprising a pair of horizontal wires laterally offset from each other a short distance. The system may also include a soil reinforcing element having a pair of longitudinal wires and a plurality of transverse wires coupled together, the soil reinforcing element being coupled to the initial wire and the terminal wire of the horizontal element, and a screen disposed on the wire facing.

Another exemplary embodiment of the disclosure may provide a system for constructing a mechanically stabilized earth structure. The system may include a wire facing bent to form a horizontal element and a vertical facing, the vertical facing having a plurality of vertical wires coupled to a plurality of facing cross wires, and the horizontal element having initial and terminal wires coupled to a plurality of horizontal wires that include a plurality of connector leads, each connector lead comprising a pair of horizontal wires laterally offset from each other a short distance. The system may also include a series of crimps defined in the horizontal wires and connector leads of the horizontal element, and a soil reinforcing element coupled to the horizontal element at a pair of crimps defined at a connector lead, the soil reinforcing element having first and second longitudinal wires and a plurality of transverse wires coupled together, wherein a lead transverse wire is disposed adjacent the initial wire and the pair of crimps extend between the first and second longitudinal wires, thereby defining an opening above each longitudinal wire.

BRIEF DESCRIPTION OF THE DRAWINGS

FIG. 1C is a side view of a system for attaching a soil reinforcing element to a wire facing element, according to one or more aspects of the present disclosure.

FIG. 2 is an isometric view of a connection device adapted to couple a soil reinforcing element to a wire facing, according to one or more aspects of the present disclosure.

DETAILED DESCRIPTION

Figure 1A:
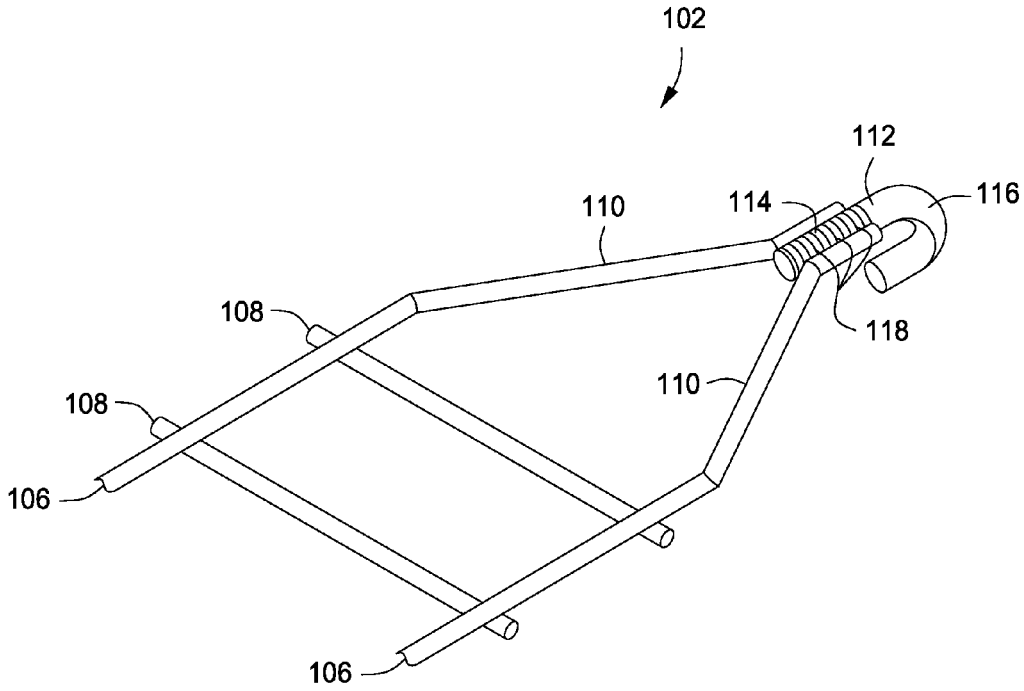
FIG. 1A is an isometric view of an exemplary soil reinforcing element, according to one or more aspects of the present disclosure.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

The present disclosure may be embodied as an improved apparatus and method of connecting an earthen formation to a welded wire facing of a mechanically stabilized earth (MSE) structure. Referring to FIGS. 1A-1D, illustrated is an exemplary system 100 for securing at least one soil reinforcing element 102 to a wire facing 104 in the construction of an MSE structure. As depicted in FIG. 1A, the soil reinforcing element 102 may include a welded wire grid having a pair of longitudinal wires 106 that extend substantially parallel to each other. The longitudinal wires 106 may be joined to a plurality of transverse wires 108 in a generally perpendicular fashion by welds at their intersections, thus forming a welded wire gridworks. In one or more embodiments, the spacing between each longitudinal wire 106 may be about 2 in., while the spacing between each transverse wire 108 may be about 6 in. As can be appreciated, however, the spacing and configuration of adjacent respective wires 106, 108 may vary for a variety of reasons, such as the combination of tensile force requirements that the soil reinforcing element 102 must endure and resist.

In one or more embodiments, the lead ends 110 of the longitudinal wires 106 may generally converge and be welded or otherwise attached to a connection stud 112. The connection stud 112 may include a first end or stem 114 and a second end or connector 116. As illustrated, the stem 114 may include a plurality of indentations or grooves 118 defined along its axial length. The grooves 118 may be cast or otherwise machined into the stem 114 thereby providing a more suitable welding surface for attaching the lead ends 110 of the longitudinal wires 106 thereto. In one embodiment, the grooves 118 can include standard thread markings. As can be appreciated, this can result in a stronger resistance weld. In one or more embodiments, the connector 116 may be hook-shaped and bent or otherwise turned about 180° from the axial direction of the stem 114 and adapted to couple or otherwise attach to the wire facing 104, as will be described below.

Figure 1B:
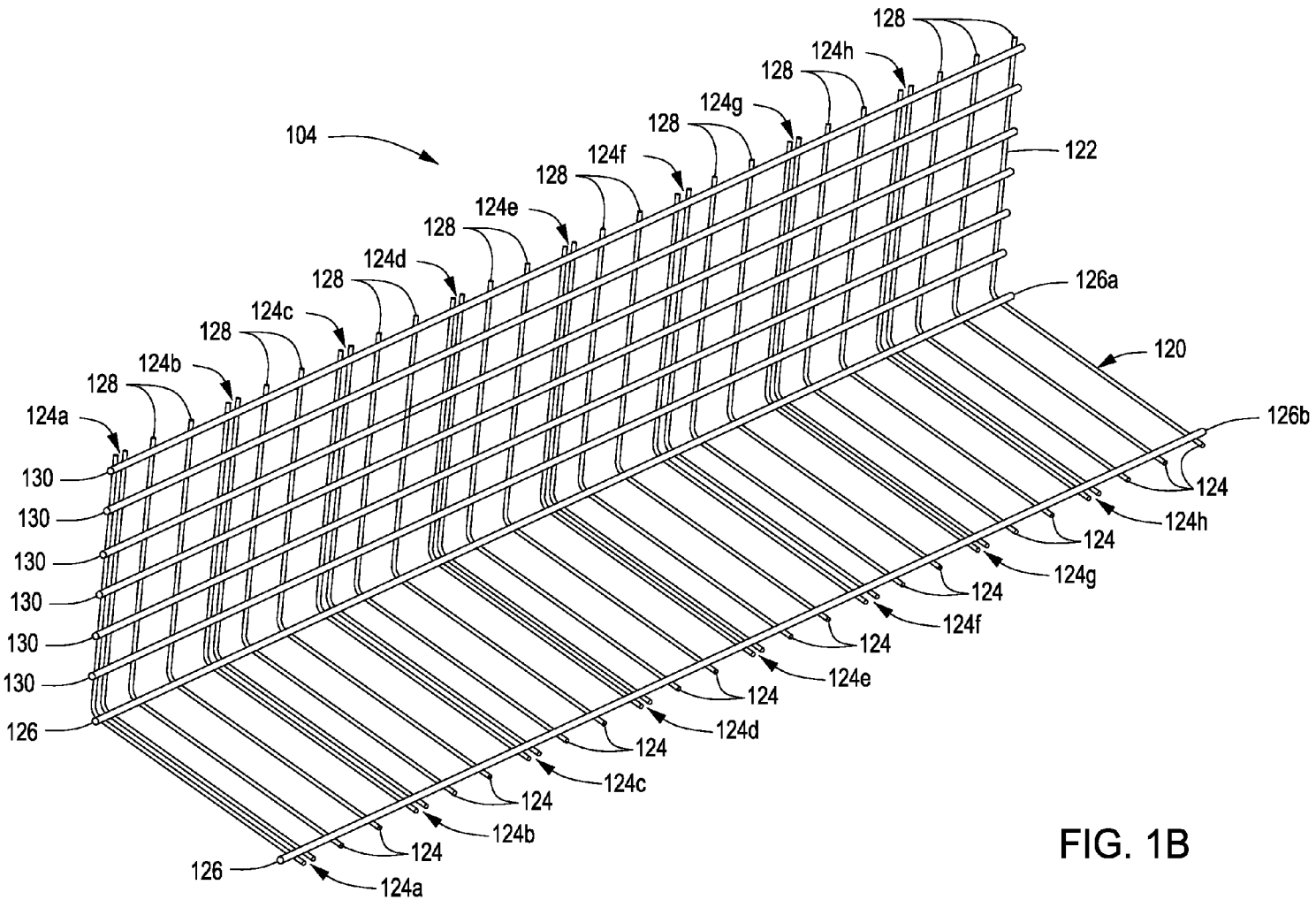
FIG. 1B is an isometric view of an exemplary wire facing element, according to one or more aspects of the present disclosure.

Referring to FIG. 1B, the wire facing 104 may be fabricated from several lengths of cold drawn wire welded and arranged into a mesh panel. The wire mesh panel can then be folded to form a substantially L-shaped structure including a horizontal element 120 and a vertical facing 122. The horizontal element 120 may include a plurality of horizontal wires 124 welded or otherwise attached to one or more cross wires 126. In the illustrated exemplary embodiment, the cross wires 126 may include an initial wire 126*a* and a terminal wire 126*b*. The initial wire 126*a* may be disposed adjacent to and directly behind the vertical facing 122, thereby being positioned inside the MSE structure. The terminal wire 126*b* may be disposed at or near the distal ends of the horizontal wires 124. The horizontal element 120 may further include other wires disposed between the initial and terminal wires 126*a,b*, such as the median wire 506*c* discussed below with reference to FIGS. 5A and 6A.

As depicted in FIG. 1B, a plurality of connector leads 124*a-h* may be equidistantly spaced from each other along the horizontal element 120 and configured to provide a visual indicator to an installer as to where a soil reinforcing element 102 may be properly attached, as will be described in greater detail below. In an embodiment, each connector lead 124*a-h* may consist of a pair of horizontal wires 124 laterally offset from each other by a short distance, such as about 1 inch. While the horizontal wires 124 adjacent the connector leads 124*a-h* may be generally spaced from each other by about 4 inches on center, each connector lead 124*a-h* may be spaced from each other by about 12 inches on center. As can be appreciated, however, such distances may vary to suit particular applications dependent on varying stresses inherent in MSE structures.

The vertical facing 122 can include a plurality of vertical wires 128 extending vertically with reference to the horizontal section 102 and equidistantly spaced from each other. In one embodiment, the vertical wires 128 may be vertical extensions of the horizontal wires 124 of the horizontal element 120. Furthermore, the connector leads 124*a-h* from the horizontal element 120 may also extend vertically into the vertical facing 122. The vertical facing 122 may also include a plurality of facing cross wires 130 vertically offset from each other and welded or otherwise attached to both the vertical wires 128 and vertical connector leads 124*a-h*. In at least one embodiment, the vertical wires 128 may be equidistantly separated by a distance of about 4 inches and the facing cross wires 130 may be equidistantly separated from each other by a distance of about 4 inches, thereby generating a grid-like facing composed of a plurality of square voids having a 4"×4" dimension. As can be appreciated, however, the spacing between adjacent wires 128, 130 can be varied to more or less than 4 inches to suit varying applications.

In one or more embodiments, the cross wires 126 of the horizontal element 120 may be larger in diameter than the cross wires 130 of the vertical facing 122. This may prove advantageous since the soil reinforcing elements 102 may be coupled or otherwise attached to the cross wires 126 where greater weld shear force is required and can be attained. In at least one embodiment, the cross wires 126 of the horizontal element 120 may be at least twice as large as the facing cross wires 130 of the vertical facing 122. In other embodiments, however, the diameter of each plurality of wires 126, 130 may be substantially the same or the facing cross wires 130 may be larger than the cross wires of the horizontal element 120 without departing from the scope of the disclosure.

Figure 1D:
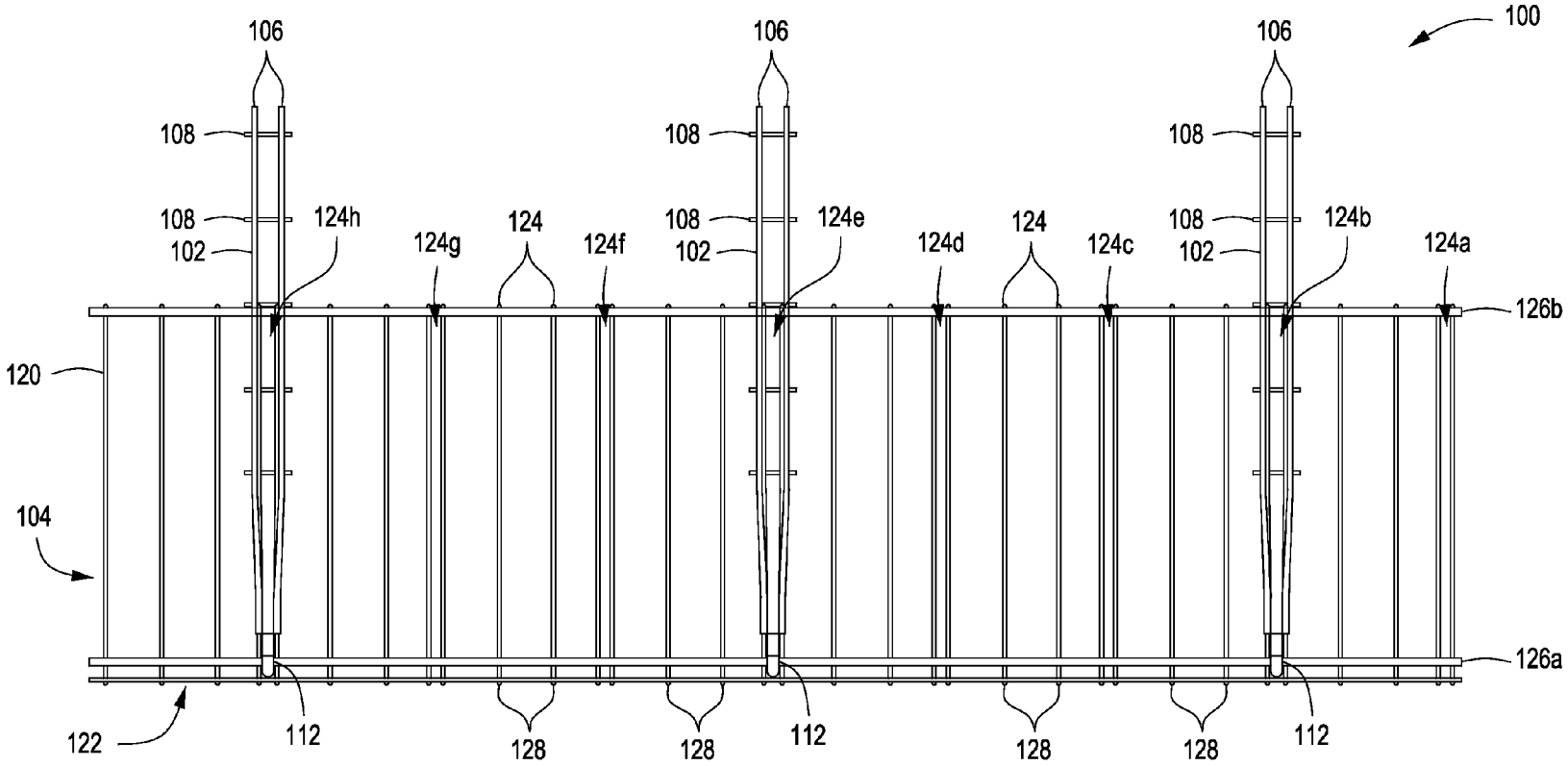
FIG. 1D is a plan view of the system of FIG. 1D, according to one or more aspects of the present disclosure.

In exemplary operation, as depicted in FIGS. 1C and 1D, soil reinforcing elements 102 may be coupled to the wire facing 104 by coupling the connection stud 112 to the initial wire 126*a*. As best seen in FIG. 1C, the connector 116 may be coupled or otherwise "hooked" to the initial wire 126*a*, thereby preventing its removal therefrom in a first direction indicated by arrow A. As depicted in FIG. 1D, the soil reinforcing elements 102 may further be attached to the wire facing 104 at one or more of the connector leads 124*a-h* of the horizontal element 120. In one or more embodiments, soil reinforcing elements 102 may be connected at each connector lead 124*a-h*, every other connector lead 124*a-h*, every third connector lead 124*a-h*, etc. For instance, FIG. 1D depicts soil reinforcing elements 102 connected at every third connector lead 124*b*, 124*e*, and 124*h*.

As can be appreciated, the reduced spacing between the pair of horizontal wires 124 that make up each connector lead 124*a-h* may provide a structural advantage. For instance, the reduced spacing may generate an added amount of weld shear resistance where the connector 116 hooks onto the initial wire 126*a*. Also, the reduced spacing may generate a stronger initial wire 126 that is more capable of resisting bending forces when stressed by the pulling of the connector 116.

In one embodiment, the terminal wire 126*b* may be located at a predetermined distance from the initial wire 126*a* to allow a transverse wire 108 of the soil reinforcing element 102 to be positioned adjacent the terminal wire 126*b* when the soil reinforcing element 102 is pulled tight against the connector 116. In at least one embodiment, the transverse wire 108 may be coupled or otherwise attached to the terminal wire 126*b*. Referring to FIG. 2, the transverse wire 108 may be positioned directly behind the terminal wire 126*b* and secured thereto using a coupling device 132, such as a hog ring, wire tie, or the like. In other embodiments, however, the transverse wire 108 may be positioned in front of the terminal wire 126*b* and similarly secured thereto with a coupling device 132, without departing from the scope of the disclosure.

Once secured with the coupling device 132, the soil reinforcing element 102 (FIGS. 1A, 1C, and 1D) may be prevented from moving toward the vertical facing 122 in a second direction indicated by arrow B in FIG. 1C, and thereby becoming disengaged. Coupling the transverse wire 108 to the terminal wire 126*b* may prove advantageous during the placement of backfill in the system 100, where tossing dirt, rocks, and/or other backfill material could potentially jar the connector 116 from hooked engagement with the initial wire 126*a* and force the soil reinforcing element 102 through the vertical facing 122 in the second direction B.

Figure 3:
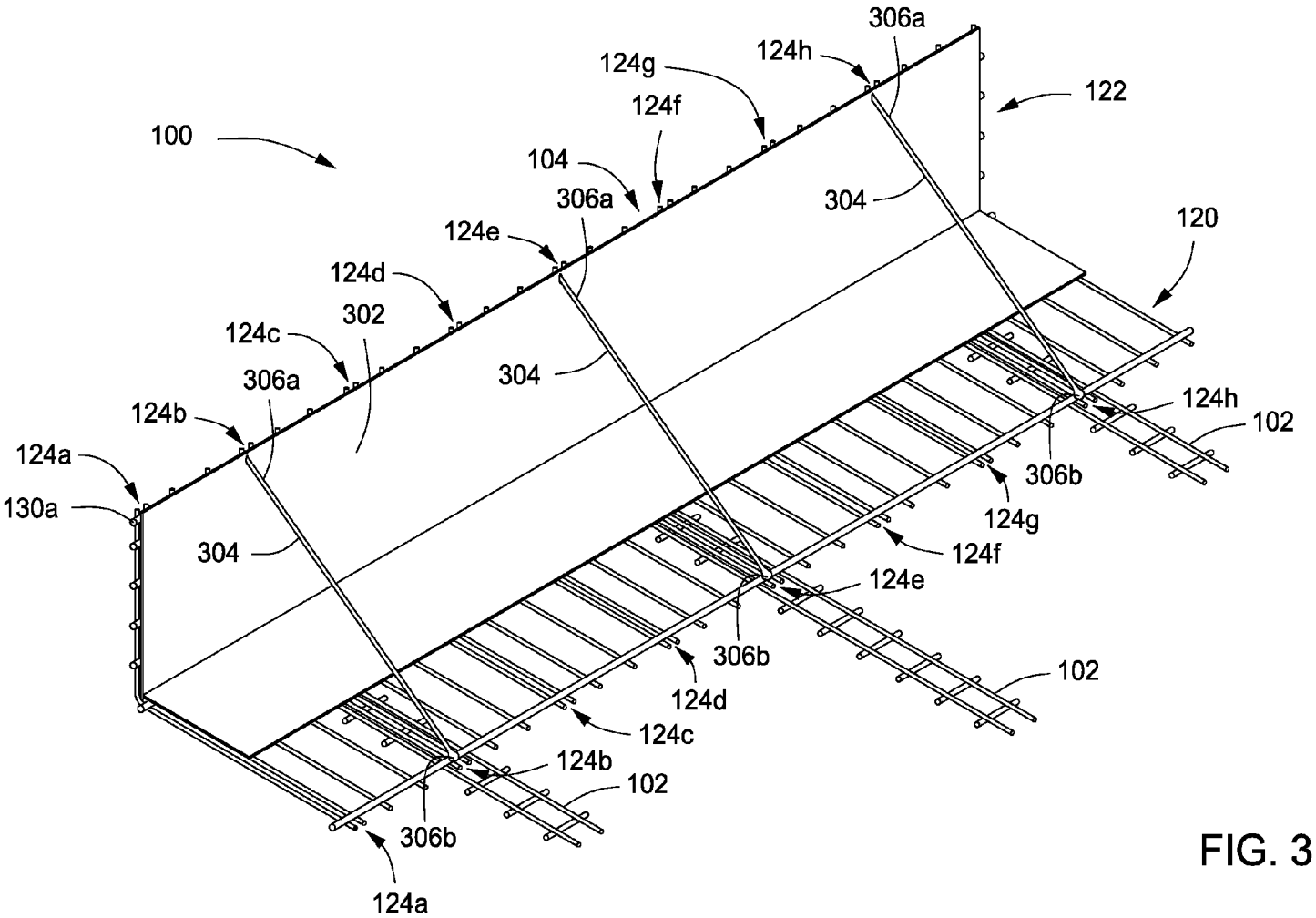
FIG. 3 is an isometric view of the system of FIGS. 1C and 1D, with a layer of fabric filter applied thereto, according to one or more aspects of the present disclosure.

Referring now to FIG. 3, the system 100 may further include a screen 302 disposed on the wire facing 104 once the soil reinforcing elements 102 have been connected as generally described above. In one embodiment, the screen 302 can be disposed on both the vertical facing 122 and the horizontal element 120. As illustrated, the screen 302 may be placed on substantially all of the vertical facing 122 and only a portion of the horizontal element 120. In other embodiments, however, the screen 302 may be placed in different configurations, such as covering the entire horizontal element 120 or only a portion of the vertical facing 122. In operation, the screen 302 may be configured to prevent fine backfill material from leaking, eroding, or raveling out of the vertical facing 122. In one embodiment, the screen 302 may be a layer of filter fabric. In other embodiments, however, the screen 302 may include construction hardware cloth or a fine wire mesh. In yet other embodiments, the screen 302 may include a layer of cobble, such as large rocks that will not advance through the square voids defined in the vertical facing 122, but which are small enough to hold back backfill material.

The system 100 may further include one or more struts 304 operatively coupled to the wire facing 104. As illustrated, the struts 304 may be coupled to both the vertical facing 122 and the horizontal element 120. In one or more embodiments, the struts 304 may be applied to the system 100 before backfill is added thereto. Once in position, the struts 304 may allow backfill to be positioned on the whole of both the horizontal and vertical sections 120, 122 until reaching the top or vertical height of the vertical facing 122. The struts 304 may allow installers to walk on the MSE structure, tamp it, and compact it fully before adding a new lift or layer, as will be described below.

During the placement of backfill, and during the life of the system 100, the struts 304 may prevent the vertical facing 122 from bending past a predetermined vertical angle. For example, in the illustrated embodiment, the struts 304 may be configured to maintain the vertical facing 122 at or near about 90° from the horizontal element 120. As can be appreciated, however, the struts 304 can be fabricated to varying lengths or otherwise attached at varying locations along the wire facing 104 to maintain the vertical facing 122 at different angles of orientation.

In one or more embodiments, the struts 304 may be coupled to the top-most cross wire 130*a* of the vertical facing 122 at a first end 306*a* of the strut 304 and to the terminal wire 126*b* of the horizontal element 120 at a second end 306*b* of the strut 304. As depicted in the illustrated exemplary embodiment, each strut 304 may be coupled to the top-most cross wire 130*a* and terminal wire 126*b* in general alignment with the connector leads 124*a-h* where the soil reinforcing elements 102 are also coupled. In other embodiments, however, the struts 304 can be connected at any location along the axial length of the top-most cross wire 130*a* and terminal wire 126*b*, without departing from the scope of the disclosure. In yet other embodiments, the struts 304 may be coupled to a segment of a vertical wire 128 of the vertical facing 122 and a segment of a horizontal wire 124 of the horizontal element 120, respectively, without departing from the scope of the disclosure.

Each strut 304 may be prefabricated with a connection device at each end 306*a,b* configured to fastened or otherwise attach the struts 304 to both the horizontal element 120 and the vertical facing 122. In at least one embodiment, the connection device may include a hook that is bent about 180° back upon itself and coupled to the ends 306*a,b* of the struts 304. In other embodiments, the connection device may include a wire loop disposed at each end 306*a,b* of the struts 304 that can be manipulated, clipped, or tied to the both the horizontal element 120 and the vertical facing 122. As can be appreciated, however, the struts 304 can be coupled to the horizontal element 120 and the vertical facing 122 by any practicable method or device known in the art.

Figure 4:
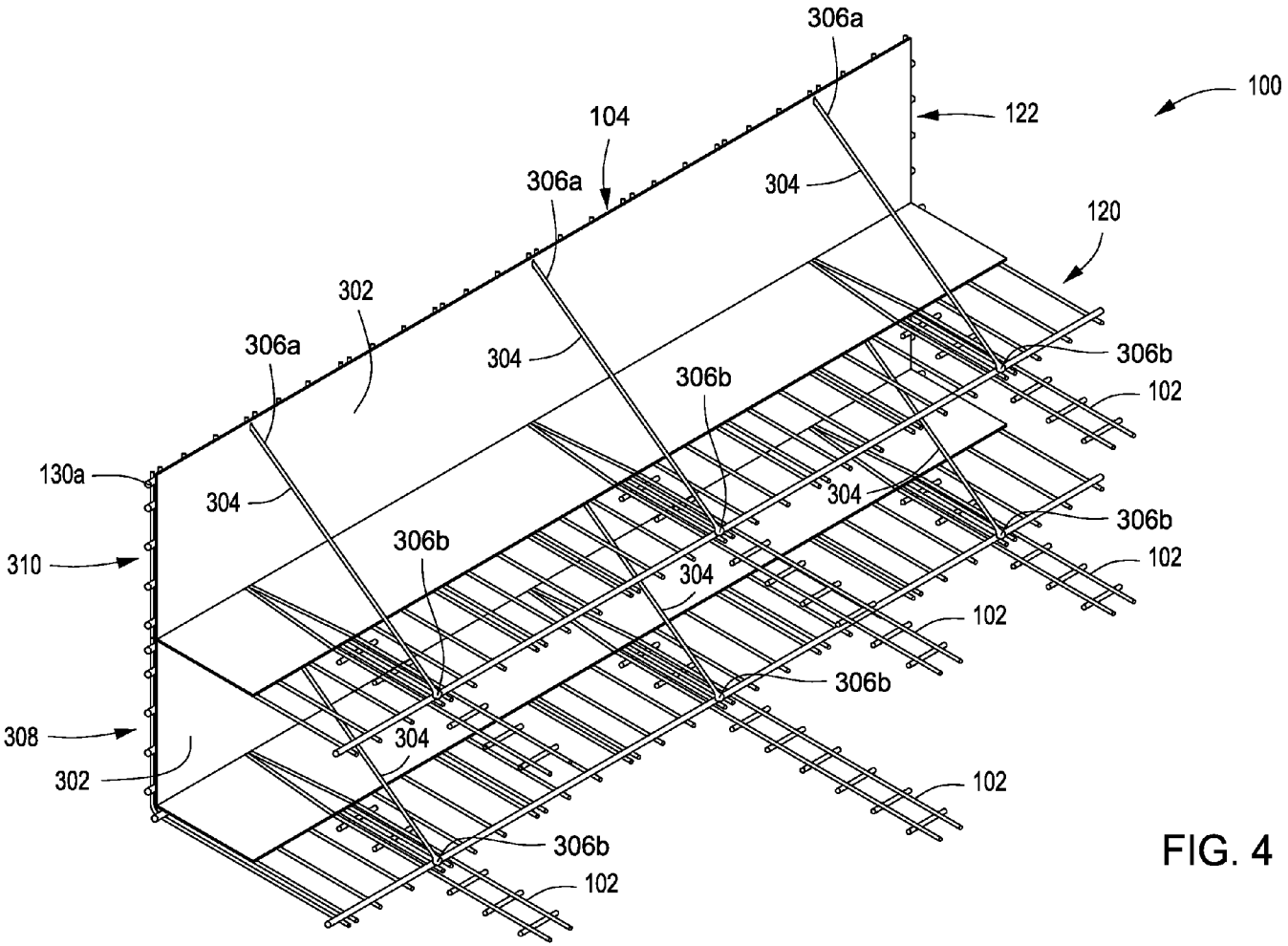
FIG. 4 is an isometric view of a pair of systems of FIGS. 1C and 1D stacked atop one another, according to one or more aspects of the present disclosure.

Referring now to FIG. 4, the system 100 can be characterized as a plurality of lifts 308, 310 configured to build an MSE structure wall to a particular required height. Each lift 308, 310 may include the elements of the system 100 as generally described above. While only two lifts 308, 310 are shown, it will be appreciated that any number of lifts may be used to fit a particular application and desired height. As depicted, a first lift 308 may be disposed substantially below a second lift 310 and the horizontal elements 120 of each lift 308, 310 may be oriented substantially parallel to and vertically offset from each other. The angle of orientation for the vertical facings 122 of each lift 308, 310 may be similar or may vary, depending on the application. For example, the vertical facings 122 of each lift 308, 310 may be disposed at angles less than or greater than 90°.

In at least one embodiment, the vertical facings 122 of each lift 308, 310 may be substantially parallel and continuous, thereby constituting an unbroken vertical ascent. In other embodiments, however, the vertical facings 122 of each lift 308, 310 may be laterally offset from each other. For example the disclosure contemplates embodiments where the vertical facing 122 of the second lift 310 may be disposed behind or in front of the vertical facing 122 of the first lift 308, and so on until the MSE wall is built to its full height.

Because of the added strength derived from the struts 304, each lift 308, 310 may be free from contact with any adjacent lift 308, 310. Thus, in at least one embodiment, the first lift 308 may have backfill placed thereon up to or near the vertical height of the vertical panel 122 and compacted so that the second lift 310 may be placed completely on the compacted backfill of the first lift 308 therebelow. Whereas conventional systems would require the vertical face 122 of the first lift 308 to be tied into the vertical face 122 of a second lift 310 to prevent its outward displacement, the present disclosure allows each lift 308, 310 to be physically free from engagement with each other. This may prove advantageous during settling of the MSE structure. For instance, where adjacent lifts 308, 310 are not in contact with each other, the system 100 may settle without causing the adjacent lifts 308, 310 to bind on each other, which can potentially diminish the structural integrity of the MSE structure. This does not, however, mean that the lifts cannot be coupled together. Instead, embodiments contemplated herein also include configurations where the distal ends of the vertical wires 128 of the first lift 308 include hooks or other elements that can be attached to the succeeding lift 310, without departing from the scope of the disclosure.

Figure 5A:
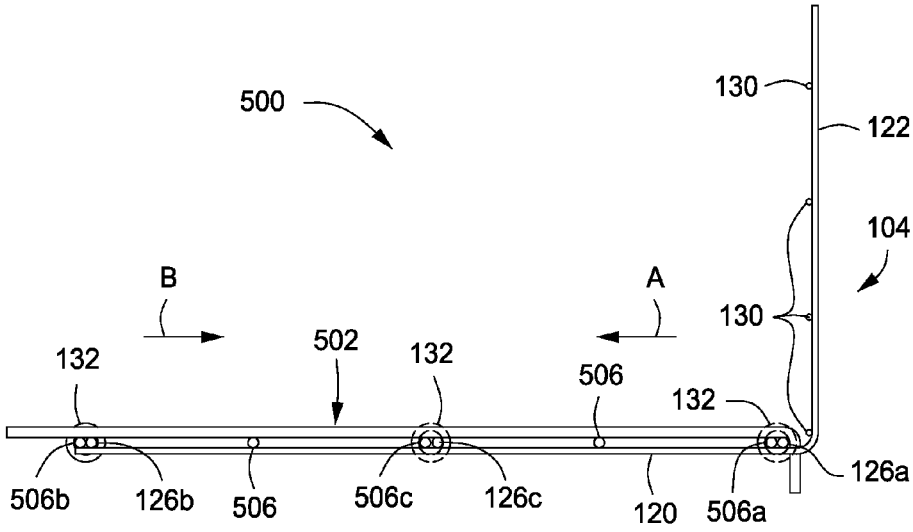
FIG. 5A is a side view of another exemplary system for attaching a soil reinforcing element to a wire facing element, according to one or more aspects of the present disclosure.
Figure 5B:
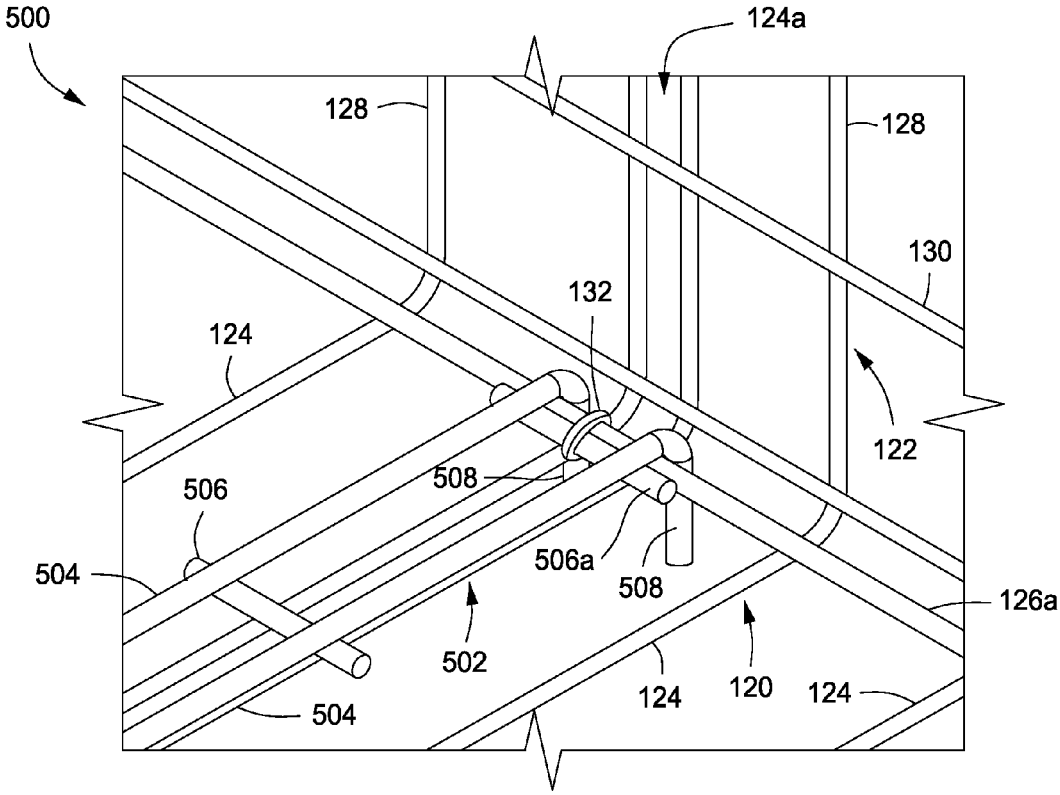
FIG. 5B is an isometric view of the system depicted in FIG. 5A, according to one or more aspects of the present disclosure.

Referring now to FIGS. 5A and 5B, illustrated is another exemplary embodiment of the system 100 depicted in FIGS. 1A-D and 2-4, embodied and described here as system 500. As such, FIGS. 5A and 5B may best be understood with reference to FIGS. 1A-D and 2-4. Similar to the system 100 generally describe above, system 500 may be configured to secure at least one soil reinforcing element 502 to a wire facing 104 in the construction of an MSE structure. The soil reinforcing element 502 may include a welded wire grid having a pair of longitudinal wires 504 extending substantially parallel to each other and joined to a plurality of transverse wires 506 in a generally perpendicular fashion by welds at their intersections. In one embodiment, each longitudinal wire 504 may include a downwardly-extending extension 508 disposed at its proximal end adjacent the vertical facing 122. In one embodiment, the extension 508 can be disposed at about 90° with respect to the longitudinal wires 504. In other embodiments, however, the extension 508 may be configured at greater or less than 90° with respect to the longitudinal wires 504.

In exemplary operation, the extensions 508 may be extended over the initial wire 126*a* such that the extensions 508 are disposed on one side of the initial wire 126*a* while a first transverse wire 506*a* of the soil reinforcing element 502 is disposed on the other side of the initial wire 126*a*. As can be appreciated, such a configuration may prevent the removal of the soil reinforcing element 502 in a first direction, as indicated by arrow A in FIG. 5A. Furthermore, the extensions 508 may be extended over the initial wire 126*a* such that the extensions 508 are disposed on the outside of each wire 124 of the connector lead 124*a*, thereby substantially straddling the connector lead 124*a* and taking advantage of the increased rigidity provided therefrom. In other embodiments, however, the extensions 508 can be placed over the initial wire 126*a* clear of the connector leads 124*a-h* at any point along the length of the initial wire 126*a*.

In at least one embodiment, a coupling device 132, such as a hog ring, wire tie, or the like, is optionally applied to the engagement between the initial wire 126*a* and transverse wire 506*a* to ensure a more secure connection, and thereby prevent the removal of the soil reinforcing element 502 in a second direction, as indicated by arrow B. As can be appreciated, in embodiments where the coupling device 132 is employed, the transverse wire 506*a* may be disposed on either side of the initial wire 126*a*, without departing from the scope of the disclosure.

Moreover, another or second transverse wire 506*b* may also be positioned directly behind the terminal wire 126*b* and secured thereto using a coupling device 132. Once secured with the coupling device 132, the soil reinforcing element 502 may be further prevented from moving toward the vertical facing 122 in the second direction B. The system 500 may also include a median wire 126*c* welded or otherwise coupled to the horizontal wires 124 and disposed laterally between the initial and terminal wires 126*a,b*. The median wire 126*c* may be configured to be disposed adjacent to a third transverse wire 506*c* of the soil reinforcing element 502 and optionally coupled thereto using a coupling device 132, or the like. Accordingly, the soil reinforcing element 502 may be coupled to the horizontal element 120 in at least three locations, thereby preventing its movement during the placement of backfill and compaction processes.

Figure 6A:
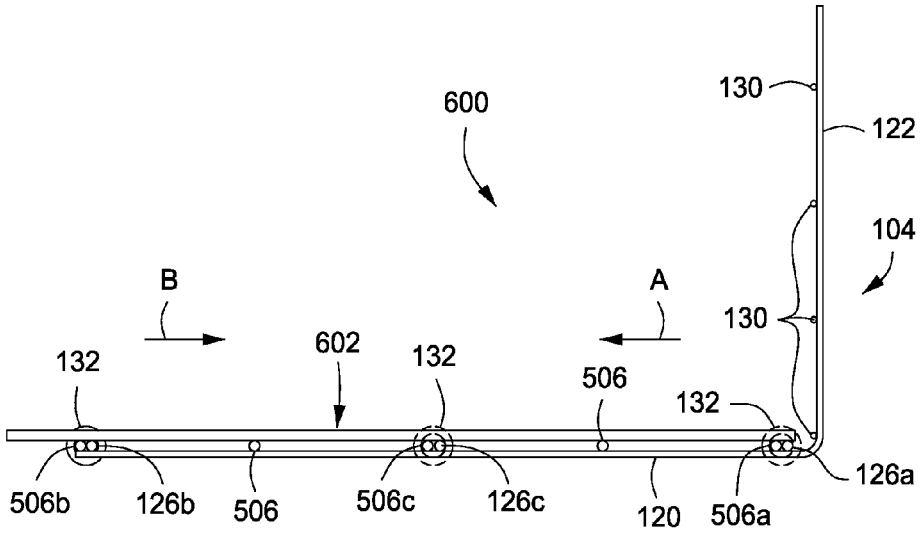
FIG. 6A is a side view of another exemplary system for attaching a soil reinforcing element to a wire facing element, according to one or more aspects of the present disclosure.
Figure 6B:
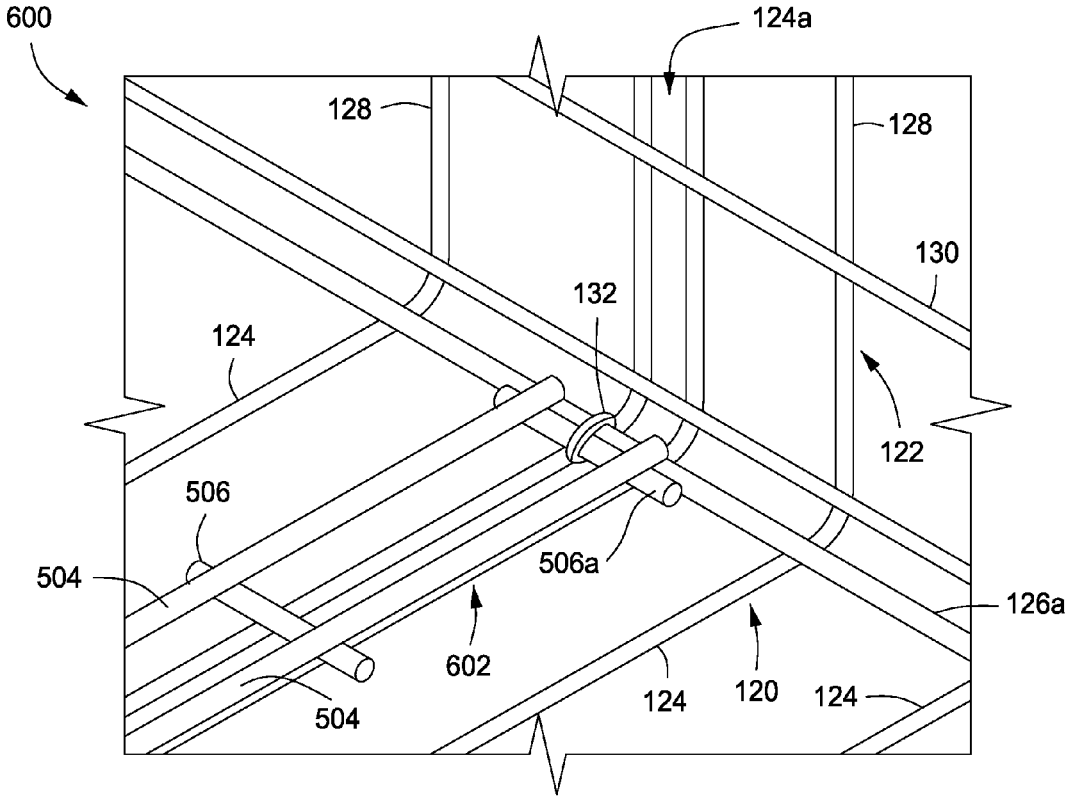
FIG. 6B is an isometric view of the system depicted in FIG. 6A, according to one or more aspects of the present disclosure.

Referring to FIGS. 6A and 6B, illustrated is another embodiment of the system 500 of FIGS. 5A and 5B, embodied as system 600. As such, FIGS. 6A and 6B may best be understood with reference to FIGS. 5A and 5B. As illustrated, the soil reinforcing element 602 may be substantially similar to the soil reinforcing element 502 of FIGS. 5A and 5B, except that the proximal ends of the longitudinal wires 504 adjacent the vertical facing 122 do not include extensions 508. Instead, the proximal ends of the longitudinal wires 504 may simply terminate a short distance past the first transverse wire 506*a*.

In exemplary operation, the soil reinforcing element 602 may be coupled to the horizontal element 120 at various locations. For example, the initial, terminal, and median wires 126*a,b,c* may be adapted to be disposed adjacent to the first, second, and third transverse wires 506*a,b,c*, respectively, for coupling thereto with an appropriate coupling device 132, as described above. As can be appreciated, embodiments are contemplated where only one or two coupling devices 132 are used to attach the soil reinforcing element 602 to the initial wire 126*a*, the terminal wire 126*b*, or the median wire 126*c*, or any combination thereof.

Figure 7A:
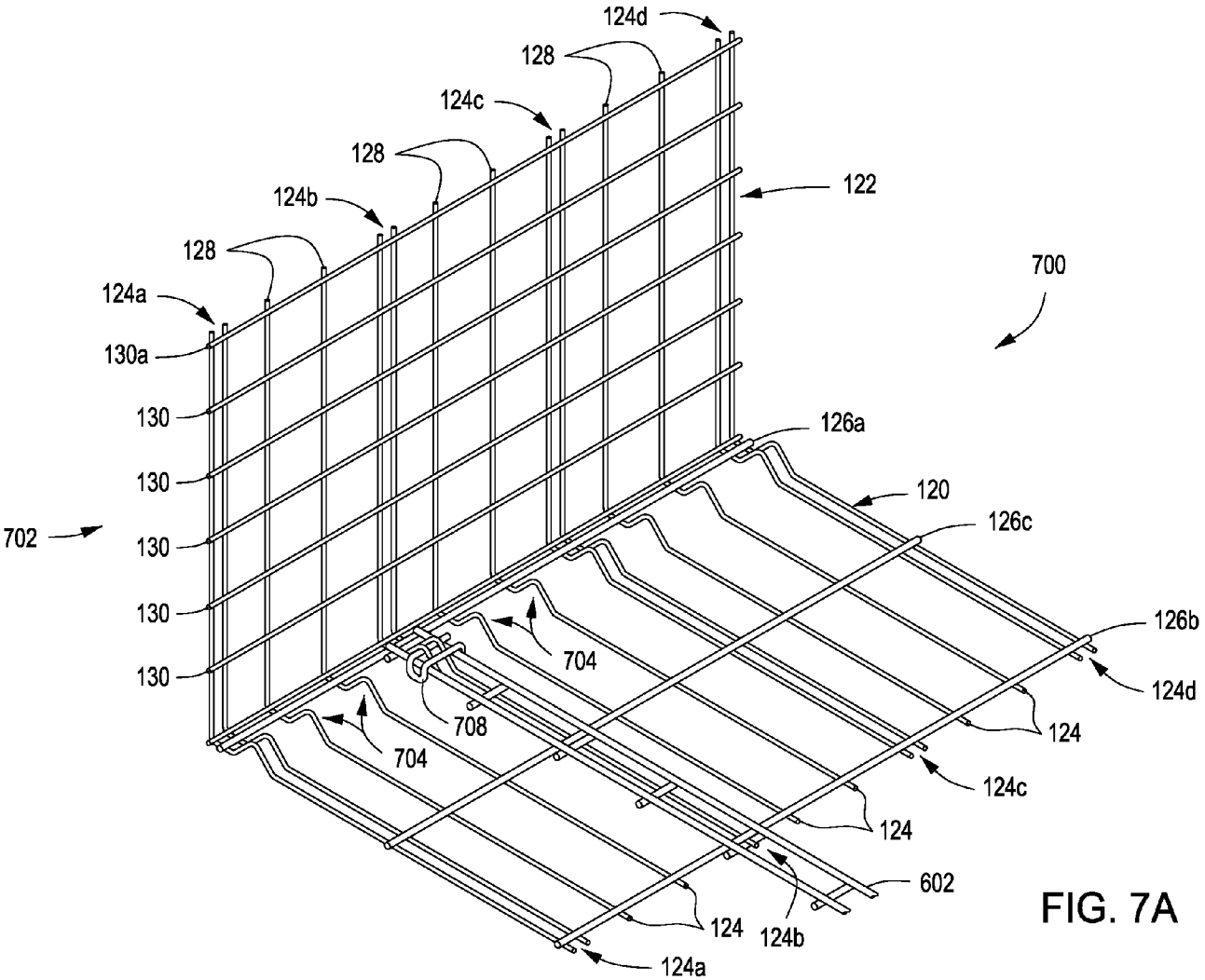
FIG. 7A is an isometric view of an exemplary wire facing element, according to one or more aspects of the present disclosure.
Figure 7B:
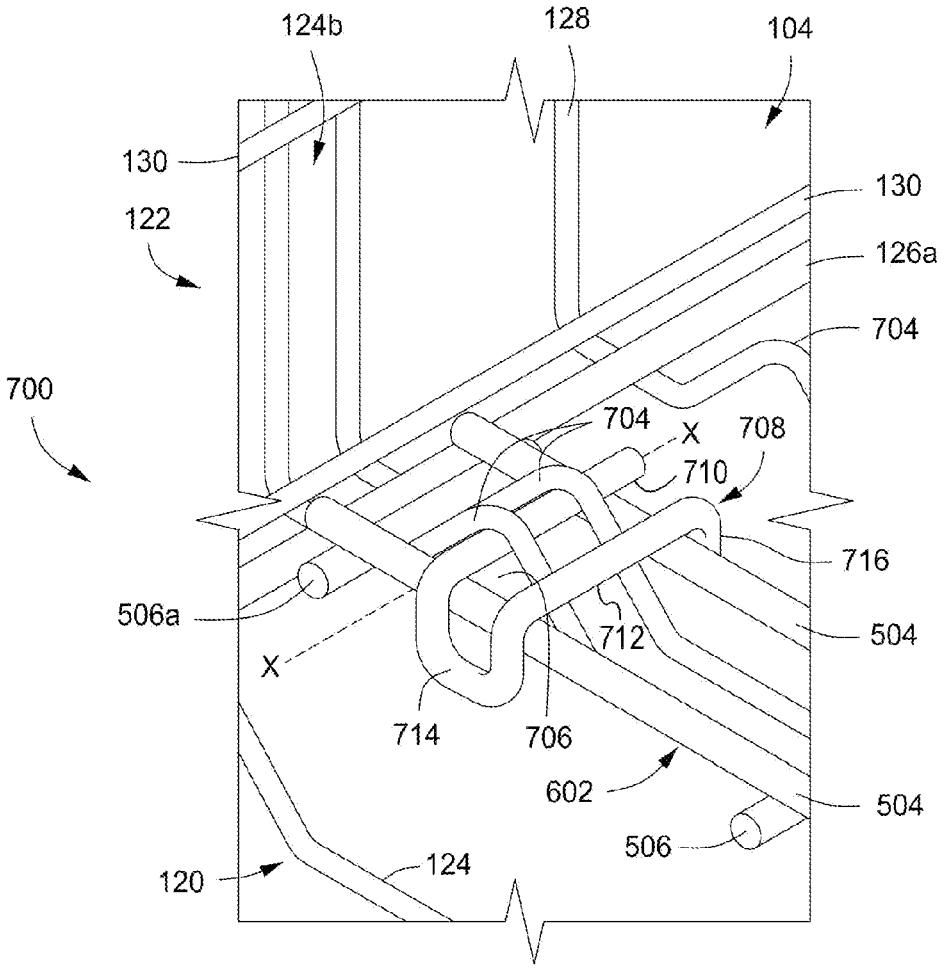
FIG. 7B is a focused isometric view of a connection system, according to one or more aspects of the present disclosure.
Figure 7C:
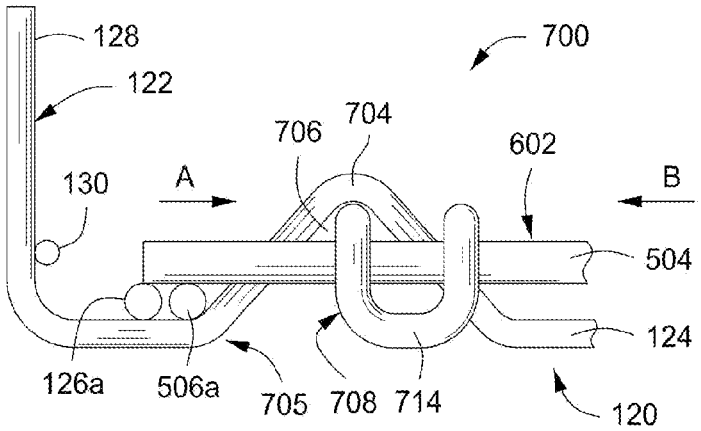
FIG. 7C is a side view of the exemplary connection system depicted in FIG. 7B, according to one or more aspects of the present disclosure.

Referring now to FIGS. 7A-7C, illustrated is another exemplary embodiment of the system 600 depicted in FIGS. 6A and 6B, embodied and described here as system 700. As such, FIGS. 7A-7C may best be understood with reference to FIGS. 6A and 6B, with continued reference to FIGS. 1A-D and 2-4. As shown in FIG. 7A, the system 700 may include a wire facing 702 substantially similar to the wire facing 104 as described above, and a soil reinforcing element 602 substantially similar to the soil reinforcing element described with reference to FIGS. 6A and 6B, wherein like numerals correspond to like elements and therefore will not be described again in detail. The wire facing 702 in FIG. 7 further includes a series of crimps 704 formed or otherwise defined in the horizontal section 120 by bending the horizontal wires 124 and/or connector leads 124*a-d* in an upward direction relative to the horizontal section 120. As illustrated, the soil reinforcing element 602 may be coupled to the horizontal section 120 at the location of at least one crimp 704, for example, a pair of crimps 704 formed at the connector lead 124*b*.

FIGS. 7B and 7C illustrate an exemplary embodiment of coupling a soil reinforcing element 602 to the horizontal section 120. As illustrated, the soil reinforcing element 602 may be placed such that its lead transverse wire 506*a* is placed directly behind the initial wire 126*a* of the horizontal section 120 and seated at or near the fillet 705 of the crimp 704. Moreover, the crimp 704 formed in the two longitudinal wires 124 of the connector lead 124*b* may extend up and between the longitudinal wires 504 of the soil reinforcing element 602, thereby defining an opening 706 above the longitudinal wires 504. In one or more embodiments, a connection device 708 may be inserted into the opening 706 defined by the crimps 704 in order to secure the soil reinforcing element 602 thereto.

In at least one embodiment, the connection device 708 may be manufactured from a continuous length of round-stock, plastic, or any similar material with sufficiently comparable tensile, shear, and compressive properties. The connection device 708 may originate with a first horizontal transverse segment 710 configured to extend through the openings 706 defined by the crimps 704. The first horizontal transverse segment 710 may include an axis X of rotation about which the connection device 708 may rotate to lock and/or secure into place. The connection device 708 may further include a second horizontal transverse segment 712 connected to the first horizontal transverse segment 710 by a downwardly extending loop 714 configured to bias against the outside surface of a longitudinal wire 504 when properly installed. The second horizontal transverse segment 712 may be configured to extend across and rest on the top of the longitudinal wires 504 of the soil reinforcing element 602. A vertical segment 716 may extend vertically downward from the second horizontal transverse segment 712, the vertical segment 716 being configured to bias against the outside surface of another longitudinal wire 504 when properly installed.

The exemplary connection device 708 may be installed by extending the first horizontal transverse segment 710 through the openings 706 formed by the crimps 704. To avoid creating an obstruction caused by the vertical segment 716, and thereby preventing entry into the openings 706, the second horizontal transverse segment 712 may be initially positioned vertically above the first horizontal transverse segment, 710. Once the first horizontal transverse segment 710 is fully extended through the openings 706, the second horizontal transverse segment 712 may then be pivoted about axis X of the first horizontal transverse segment 710, and lowered to the top of the longitudinal wires 504 of the soil reinforcing element 604. As can be appreciated, the downwardly extending loop 714 and the vertical segment 716 may be configured to bias against the outside surfaces of the opposing longitudinal wires 504, thereby preventing removal of the connection device 708. Moreover, with the connection device 708 properly secured, the soil reinforcing element will be unable to move in first and second directions, as indicated by arrows A and B, respectively, in FIG. 7C.

It should be noted that the exemplary embodiments disclosed and described with reference to FIGS. 5A, 5B, 6A, 6B, and 7A-7C may be combined with or otherwise utilize the screen 302 and struts 304 as generally described with reference to FIGS. 3 and 4. It should be further noted and appreciated, that the embodiments disclosed and described with reference to FIGS. 5A, 5B, 6A, 6B, and 7A-7C may also be implemented and/or characterized as a plurality of lifts 308, 310, where the systems 500, 600, and 700 may be disposed one atop the other to thereby construct an MSE structure to a predetermined height.

The foregoing disclosure and description of the disclosure is illustrative and explanatory thereof. Various changes in the details of the illustrated construction may be made within the scope of the appended claims without departing from the spirit of the disclosure. While the preceding description shows and describes one or more embodiments, it will be understood by those skilled in the art that various changes in form and detail may be made therein without departing from the spirit and scope of the present disclosure. For example, various steps of the described methods may be executed repetitively, combined, further divided, replaced with alternate steps, or removed entirely. In addition, different shapes and sizes of elements may be combined in different configurations to achieve the desired earth retaining structures. Therefore, the claims should be interpreted in a broad manner, consistent with the present disclosure.

I claim:

1. A system for constructing a mechanically stabilized earth structure, comprising:

a soil reinforcing element having a plurality of transverse wires coupled to pair of longitudinal wires, wherein the pair of longitudinal wires have lead ends that converge and are coupled to a connection stud having first and second ends, the first end being coupled to the lead ends and the second end comprising a connector; and a wire facing having a bend formed therein to form a horizontal element and a vertical facing, the vertical facing having a plurality of vertical wires coupled to a plurality of facing cross wires, and the horizontal element comprising:

initial and terminal wires coupled to a plurality of horizontal wires; and a plurality of connector leads, each comprising two horizontal wires of the plurality of horizontal wires, the two horizontal wires being laterally offset from each other by a short distance, wherein the connector is detachably coupled to the initial wire between the two horizontal wires of a connector lead of the plurality of connector leads, and one of the plurality of transverse wires of the soil reinforcing element is detachably coupled to the terminal wire, such that at least a portion of the soil reinforcing element extends beyond an end portion of the horizontal element.

2. The system of claim 1, wherein the connector is a hook bent about 180° with respect to the first end of the connection stud and configured to be hooked onto the initial wire.

3. The system of claim 1, wherein the initial wire is disposed adjacent to and directly behind the vertical facing and the terminal wire is disposed at distal ends of the horizontal wires.

4. The system of claim 1, wherein the first transverse wire is detachably coupled to the terminal wire with a hog ring.

5. The system of claim 1, further comprising a strut having a first end coupled to the vertical facing and a second end coupled to the horizontal element, the strut being configured to maintain the vertical facing at a predetermined angle with respect to the horizontal element.

6. The system of claim 5, wherein the first end of the strut is coupled to a top-most facing cross wire of the vertical facing and the second end of the strut is coupled to the terminal wire of the horizontal element.

7. A method of constructing a mechanically stabilized earth structure, comprising:

providing a first lift comprising a first wire facing being bent to form a first horizontal element and a first vertical facing, the first vertical facing having a plurality of vertical wires coupled to a plurality of facing cross wires, and the first horizontal element comprising:

an initial wire disposed adjacent the first vertical facing;

a terminal wire, each of the initial wire and the terminal wire coupled to a plurality of horizontal wires; and a plurality of connector leads, each comprising two horizontal wires of the plurality of horizontal wires, the two horizontal wires being laterally offset from each other by a short distance;

detachably coupling a soil reinforcing element to the initial wire of the first horizontal element between the two horizontal wires of a connector lead of the plurality of connector leads, the soil reinforcing element detachably coupling to the initial wire via a connector of a connection stud coupled to the soil reinforcing element, and the soil reinforcing element further detachably coupling to the terminal wire of the first horizontal element, such that at least a portion of the soil reinforcing element extends beyond an end portion of the first horizontal element;

placing a screen on the first wire facing whereby the screen covers at least a portion of the first vertical facing and first horizontal element; and placing backfill on the first lift to a height of the first vertical facing.

8. The method of claim 7, further comprising coupling a first end of a strut to the first vertical facing and a second end of the strut to the first horizontal element, the strut being configured to maintain the first vertical facing at a predetermined angle with respect to the first horizontal element.

9. The method of claim 7, further comprising placing a second lift on the backfill of the first lift, the second lift comprising a second wire facing being bent to form a second horizontal element and a second vertical facing.

10. The method of claim 9, wherein the second lift is completely supported by the backfill of the first lift and the first and second vertical facings are laterally offset from each other.

11. A system for constructing a mechanically stabilized earth structure, comprising:

a wire facing bent to form a horizontal element and a vertical facing, the vertical facing having a plurality of vertical wires coupled to a plurality of facing cross wires, and the horizontal element having an initial wire disposed adjacent the vertical facing, and a terminal wire, each of the initial wire and the terminal wire coupled to a plurality of horizontal wires that include a plurality of connector leads, each connector lead comprising two horizontal wires of the plurality of horizontal wires, the two horizontal wires being laterally offset from each other a short distance;

a soil reinforcing element having a pair of longitudinal wires and a plurality of transverse wires coupled together, the soil reinforcing element being detachably coupled to the initial wire of the horizontal element between the two horizontal wires of a connector lead of the plurality of connector leads, the soil reinforcing element detachably coupled to the initial wire via a connector of a connection stud coupled to the soil reinforcing element, and the soil reinforcing element further being detachably coupled to the terminal wire of the horizontal element, such that at least a portion of the soil reinforcing element extends beyond an end portion of the horizontal element; and a screen disposed on the wire facing.

12. The system of claim 11, wherein the horizontal element further comprises a median wire coupled to the plurality of horizontal wires and wherein one of the transverse wires of the soil reinforcing element is detachably coupled to the median wire.

13. The system of claim 11, further comprising a strut having a first end coupled to a top-most facing cross wire of the vertical facing and a second end coupled to the terminal wire, the strut being configured to maintain the vertical facing at a predetermined angle with respect to the horizontal element.

14. The method of claim 7, wherein the connector is a hook bent about 180° with respect to a first end of the connection stud and configured to be hooked onto the initial wire.

15. The system of claim 11, wherein the connector is a hook bent about 180° with respect to a first end of the connection stud and configured to be hooked onto the initial wire.

* * * * *